United States Patent [19]

Spencer

[11] Patent Number: 4,588,138

[45] Date of Patent: May 13, 1986

[54] WEB WINDING MACHINE

[75] Inventor: Harvey J. Spencer, Green Bay, Wis.

[73] Assignee: Paper Converting Machine Company, Green Bay, Wis.

[21] Appl. No.: 626,371

[22] Filed: Jun. 29, 1984

[51] Int. Cl.[4] ..... B65H 18/16; B65H 18/20

[52] U.S. Cl. ..... 242/64; 242/66

[58] Field of Search ..... 242/56 A, 64, 66

[56] References Cited

U.S. PATENT DOCUMENTS

| | | | |
|---|---|---|---|
| Re. 28,353 | 3/1975 | Nystrand et al. . | |
| 2,385,691 | 9/1945 | Corbin et al. | 242/56.8 |
| 2,611,552 | 9/1952 | Nystrand . | |
| 2,736,508 | 2/1956 | Langbo | 242/56 A |
| 2,769,600 | 11/1956 | Kwitek et al. . | |
| 2,970,786 | 2/1961 | Justus | 242/56 A |
| 2,984,426 | 5/1961 | Johnson . | |
| 2,995,314 | 8/1961 | Nystrand . | |
| 3,087,687 | 4/1963 | Grettve . | |
| 3,734,423 | 5/1973 | Kataoka . | |
| 3,869,095 | 3/1975 | Diltz | 242/66 X |
| 4,133,495 | 1/1979 | Dowd | 242/66 |
| 4,171,106 | 10/1979 | Crouse | 242/66 |
| 4,327,877 | 5/1982 | Perini | 242/74 X |
| 4,408,727 | 10/1983 | Dropczynski | 242/66 X |

FOREIGN PATENT DOCUMENTS

| | | | |
|---|---|---|---|
| 691282 | 4/1940 | Fed. Rep. of Germany | 242/66 |

*Primary Examiner*—Billy S. Taylor

*Attorney, Agent, or Firm*—Tilton, Fallon, Lungmus & Chestnut

[57] ABSTRACT

An apparatus for winding a web of sheet material into a roll on a core includes a pair of rollers and a source of vacuum for drawing a vacuum in the space between the rollers. The vacuum holds the core in the space between the rollers. The core is rotated by the rollers, and the web is wound on the rotating core.

27 Claims, 10 Drawing Figures

WEB WINDING MACHINE

BACKGROUND OF THE INVENTION

This invention relates to web winding machines, and, in particular, to a surface winder in which a core and the product wound on the core is held against the winding rollers by vacuum.

In the field of winding and reeling, there are two basic and well-known methods for winding a web or strip of material on cores, namely, center winding and surface winding. In center winding, a core is mounted on a driven mandrel, or driven mandrels are inserted into one or both ends of a core. The mandrel rotates the core to wind the web on a core. An automatic winder which includes multiple mandrels mounted on a rotating turret which indexes from one position to the next is described in U.S. Pat. No. 2,611,552. For higher speed continuous operation, a continuously rotating turret can be used as described in U.S. Pat. No. 2,769,600.

In a center winding machine, the rotating speed of the mandrel must decrease as roll build-up occurs. U.S. Pat. No. 2,995,314 describes a means for achieving a controlled rate of deceleration as a function of the rate of roll build-up either mechanically or electrically.

Current state of the art for center winding includes continuously rotating turrets and variable speed mandrel drives to achieve speeds over 2500 feet per minute. Because the mandrel is driven at a controlled rate, and because there are no external rollers, belts, or other devices which contact the outer surface of the roll being wound, center winding has distinct advantages relative to high loft or highly embossed sheets since it does not apply excessive external pressures which calender the sheet or compress the embossments.

However, the steps of mounting the cores on the mandrels and stripping the completed logs from the mandrels are time-consuming and can limit the productive ratings for high speed machinery. This is especially true when rolls of relatively short length are being wound which must be stripped from the mandrel more frequently. It will be recognized that as machines get wider, more time is required for stripping the wound product or log, and this, too, can be speed-limiting. The small diameter mandrels can also experience vibration as they rotate at high speed, thereby imposing a limit on machine speed. There are also practical limits to the length of the mandrel relative to an acceptable core diameter, the core diameter being dictated by marketing considerations and dispensing means. Limits on the width of center winding machines affect the production rate.

The second well-known method of winding is surface winding in which the core and/or material being wound thereon are driven by contact with belts, rotating rolls, or the like which rotate at or near web speed. Again, this field is replete with numerous examples of surface winding devices.

Narrow webs can be wound on cores that are trapped within a three-roll system, or which are driven from one or both ends. When web widths exceed about 40 inches, caging or entrapment means are needed to keep the wide core and wide roll in contact with the rollers.

The use of a turret or reel having three or more pairs of rollers to cradle the core and/or wound roll is well known. In some instances, as in U.S. Pat. No. 2,385,691, the core or roll being wound is entrapped between two cradle rolls and a third co-acting bedroll or between one of the turret rolls, a bedroll, and a third rider roll. The turret is indexed intermittently to move the core and product from a first winding station to a second station for completion of the wind. U.S. Pat. No. 2,984,426 describes a rotating turret with six rolls wherein the core and wound product are contained between two cradle rolls and a third co-acting bedroll or a pivoting rider roll.

A derivation of this approach according to U.S. Pat. No 4,327,877 involves the use of a drum instead of a turret. The roll being wound is trapped between the winding drum, a secondary winding drum mounted below the first winding drum, and a pivoting rider roll. In this instance, core advancement from a first winding stage to a second winding stage is achieved by introducing a speed differential between the two winding drums. The rider roll that pivots inwardly to create the three-roll entrapment must be pivoted out of the way for release of the wound log, and, for a discrete period of time, winding occurs without a positive three-roll entrapment. This results in the loss of positive continuous control for maintaining density and diameter control and creates the added disadvantage of a high inertia pivoting motion at higher log production rates, for example, about 15 or 20 per minute.

When a turret is used to support the cradle rolls, three-point entrapment is needed for the winding station. Intermittent indexing of the turret is speed limiting because of the high mass construction and inertia as the turret indexes. The machine must also compensate for the indexing advancement of the web in order to keep the web from breaking, especially at high indexing rates.

U.S. Pat. Nos. 4,327,877 and 4,133,495 utilize vacuum-providing for holding the web against the core. The vacuum acts on the web and does not assist in holding the core on the winding rolls.

The prior art also includes indexing reels having pairs of rider rolls therein working in conjunction with external devices to provide three-roll entrapment. These external devices take the form of pivot rolls, pivoting belt systems, and stationary belt systems as shown, for example, in U.S. Pat. Nos. 3,087,687 and 3,734,423. Again, intermittent motion of the turret is used to transfer the core and the small diameter wound roll to a second winding position where the roll is completed.

SUMMARY OF THE INVENTION

The invention provides a surface winding machine in which the core is held against a pair of rotating cradle rollers by a partial vacuum which is drawn in the space between the rollers. The rollers rotate the core at or near web speed, and the wound log is maintained against the rollers by the vacuum as the log is built up. The wound log can be discharged from the machine merely by shutting off the vacuum.

The cradle rollers are advantageously mounted in a rotating turret with other pairs of cradle rollers. The turret rotates the pairs of rollers past a core-feeding station, a web attaching station, and a discharge station at which the vacuum is shut off. The web is wound on the rotating core as the turret moves a pair of rollers toward the discharge station, and the wound log falls by gravity from the rollers at the discharge station.

One of the rollers of each pair can be pivotally mounted on the turret so that the space between the rollers can be increased as the diameter of the log increases. The larger space increases the area of the log which is subjected to vacuum and therefore increases the vacuum holding force.

Thus, it is the primary objective of this invention to provide a surface winding device wherein the core or wound log is contained between only two support rollers, which orbit continuously to provide high log cycling rates.

It is another object of this invention to maintain the core and/or wound log in contact with the two support rollers by vacuum means and thus eliminate the requirement for a third entrapment or containment device external of the turret.

It is a further objective of this invention to provide wound log density-changing means which are compatible with continuous turret rotation and do not require separate pivoting or indexing motions.

It is still another objective of this invention to define a method and device wherein normal machine width limitations are eliminated.

It is a further objective of this invention to define a method and device wherein speed limitations are not subject to the dynamic limitations of mechanical indexing or intermitten pivoting of external sources.

It is a further objective of this invention to eliminate the previously used third contact surface to contain a roll between the cradle rolls and hence minimize the de-bulking factor of the third contact roller device.

These and other objectives for providing a method and device for high speed winding approaching the softness and density of center wound products but without mandrels, as well as production of completed products at high discharge rates in logs per minute with mechanical and electrical simplification, are further described in the detailed description of the invention.

DESCRIPTION OF THE DRAWING

The invention will be explained in conjunction with an illustrative embodiment shown in the accompanying drawing in which.

DESCRIPTION OF SPECIFIC EMBODIMENT

Figure 1:
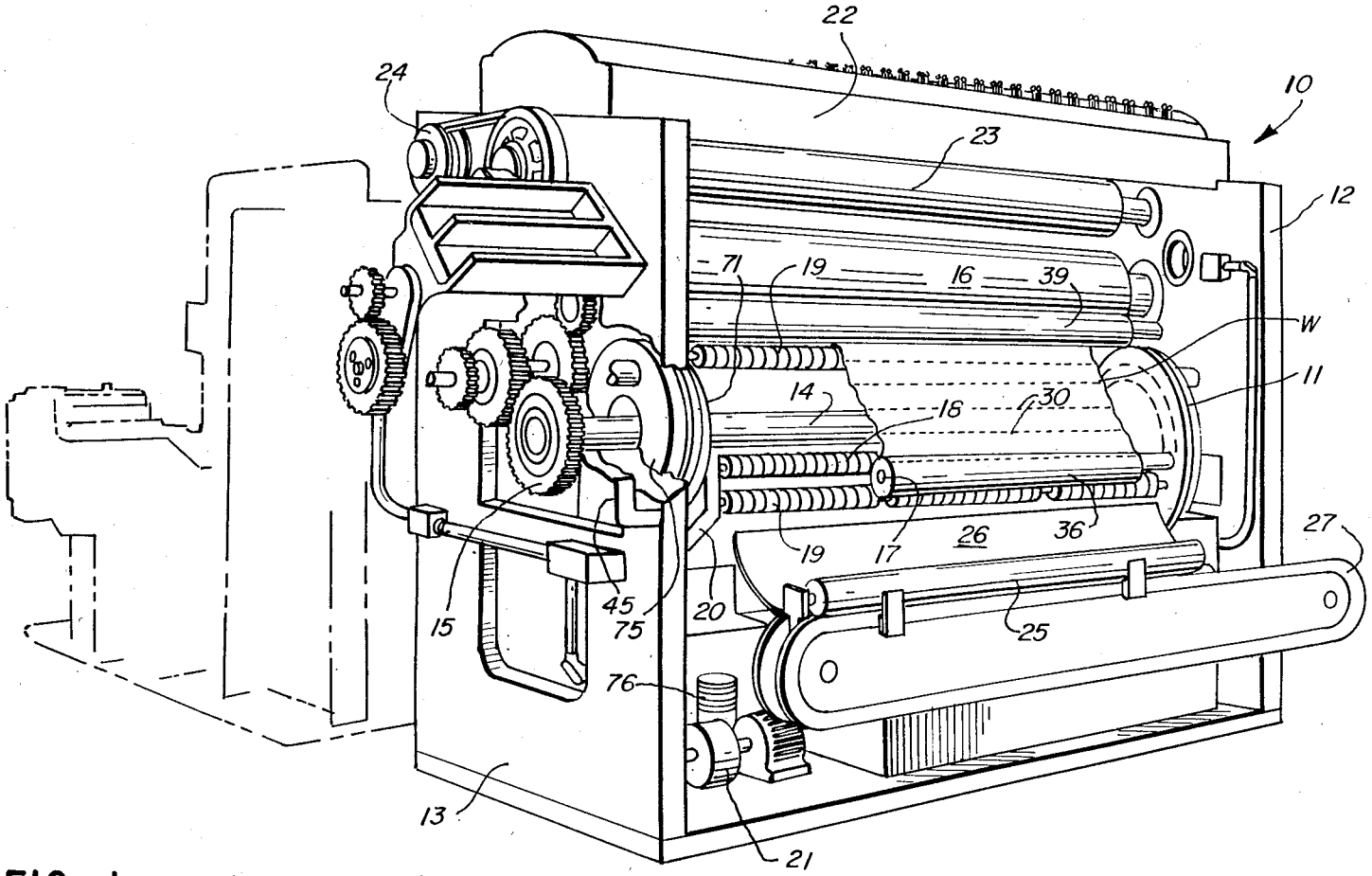
FIG. 1 is a front perspective view of a surface rewinder formed in accordance with the invention.

Referring to FIG. 1, a rewinder 10 includes a rotatable turret assembly 11 which is supported by side frames 12 and 13. The turret is supported for rotation on a turret tube 14 which is rotated by gear 15. The turret co-acts with, but rotates much slower than, a bedroll 16 (FIG. 2) which transfers a web W onto a core 17.

Figure 3:
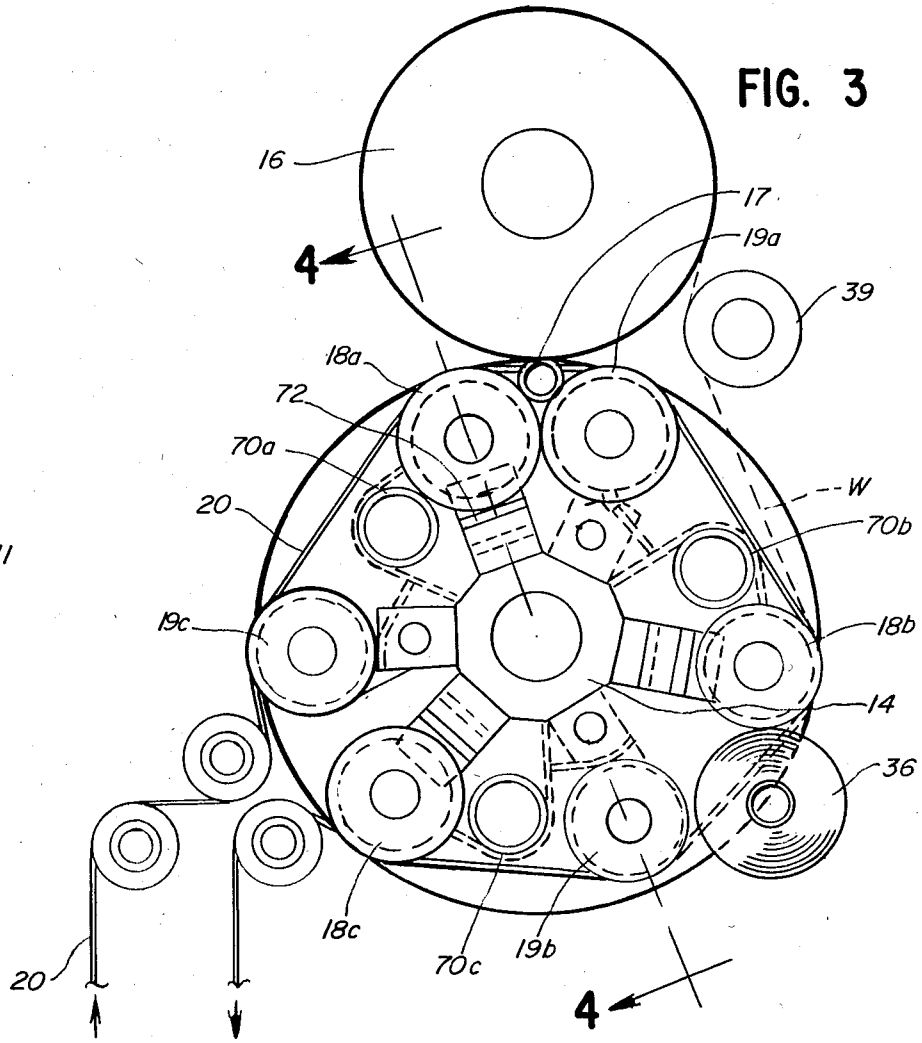
FIG. 3 is an enlarged view of the turret assembly of FIG. 2.

Three pairs of winding rolls or cradle rollers 18 and 19 (see also FIGS. 2 and 3) are supported from the turret tube 14 for rotation about axes which extend parallel to the axis of the turret tube. The cradle rollers orbit with the turret, and the rollers are rotated as they orbit by an endless drive belt 20 which is driven by a fixed or variable speed drive 21.

The rewinder also includes conventional components such as a perforating head 22, a co-acting perforator roll 23, and a variable speed sheave 24 for draw rolls. Completed wound rolls or logs 25 are discharged into a discharge trough 26 and a takeaway conveyor 27.

The rewinder would typically operate in conjunction with other conventional devices such as unwind stands, printers, and embossers, none of which are shown in the drawing and which would be installed to the left of and behind rewinder 10. The conveyor 27 can deliver the logs to a conventional log saw for dividing the log into consumer-size rolls.

Figure 2:
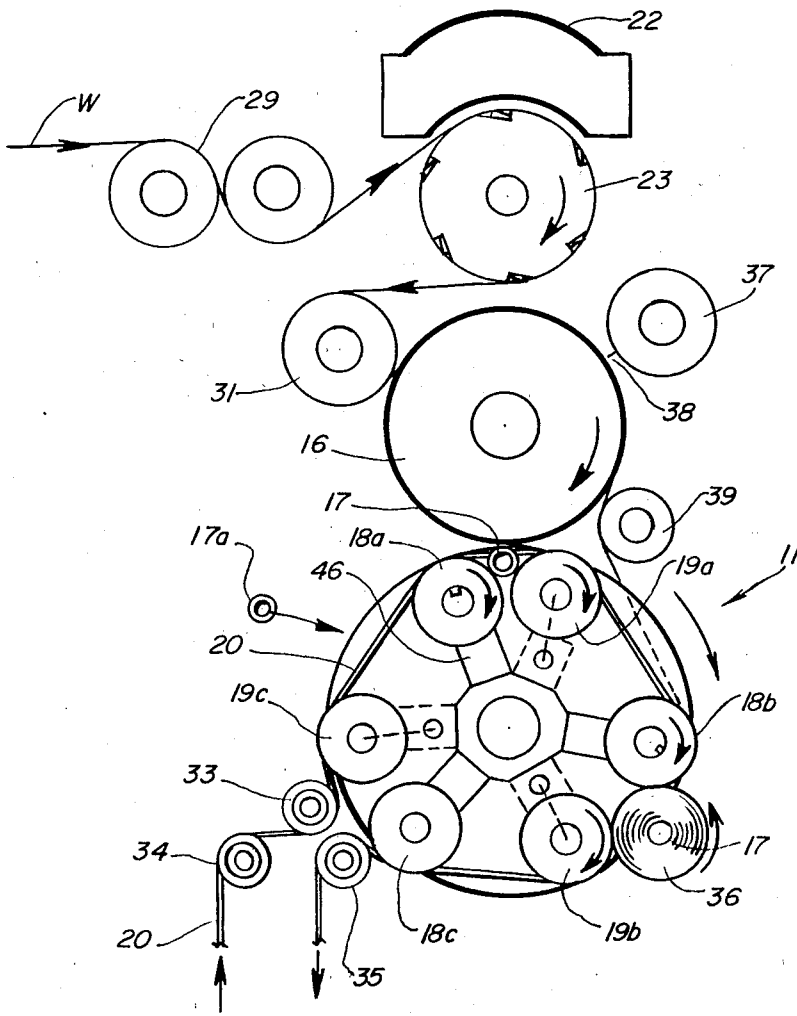
FIG. 2 is a schematic side view showing web travel through the machine.

In FIG. 2 a web W wraps a pair of draw rolls 29 and passes between the co-acting perforator head 22 and perforator roll 23, which provide transverse perforations 30 (FIG. 1) in the web. The perforated web continues around a roller 31 to the bedroll 16. The bedroll may be constructed in accordance with U.S. Reissue Pat No. 28,353 and includes pusher fingers which transfer the leading end of the web to a pre-glued core 17 which is supported by a pair of cradle rollers **18*a* and 19*a* at the 12 o'clock position in FIG. 2. Two other pairs of cradle rollers 18*b*, 19*b* and 18*c*, 19*c* are located at the 4 o'clock and 8 o'clock positions of FIG. 2**.

All of the cradle rollers are rotated by the drive belt 20 which engages a pulley on the shaft of each roller. The drive belt passes over idler pulleys 33, 34, and 35 and is driven by a drive pulley on the motor 21 (FIG. 1). As the cradle rollers are rotated by the drive belt, the rollers are orbited in a clockwise direction by the rotating turret shaft 14.

As will be explained in detail hereinafter, a vacuum is drawn in the space between the cradles rollers **18*a* and 19*a* to hold the core 17 against the rollers. The cradle rollers are driven by the belt 20 to rotate at or near the speed at which the web is delivered by the bedroll 16**, and the core is rotated at about the same speed by virtue of its contact with the cradle rollers.

The cradle rollers are orbited clockwise past a core-feeding station indicated at **17*a* in FIG. 2 where a core 17 is delivered to the space between the rollers. The core can be provided with axially spaced circumferential bands of glue prior to delivery to the cradle rollers. When the rollers reach the 12 o'clock position illustrated in FIG. 2, the leading edge of the web is transferred to the glued core, and the web is wound on the rotating core as the core continues to orbit with the turret. In FIG. 2 the wound roll 36 on the cradle rollers 18*b* and 19*b*** has been orbited to the 4 o'clock position before the web is severed and transferred to the next core at the 12 o'clock position.

The web is severed by a chopper roll 37 which carries a blade 38. A conventional timing mechanism rotates the chopper roll to move the blade into U-shaped blades which are housed within the bedroll 16 when the desired length of web has passed the blade. The tail end of the severed web passes over roll 39, over the cradle roller **18*b* at the 4 o'clock position of FIG. 2, and onto the wound roll 36. After a roll or log is completely wound, the vacuum between the cradle rollers which hold the wound roll is shut off, and the roll falls by gravity into the discharge trough 26 and onto the takeaway conveyor 27 (FIG. 1**).

Figure 4:
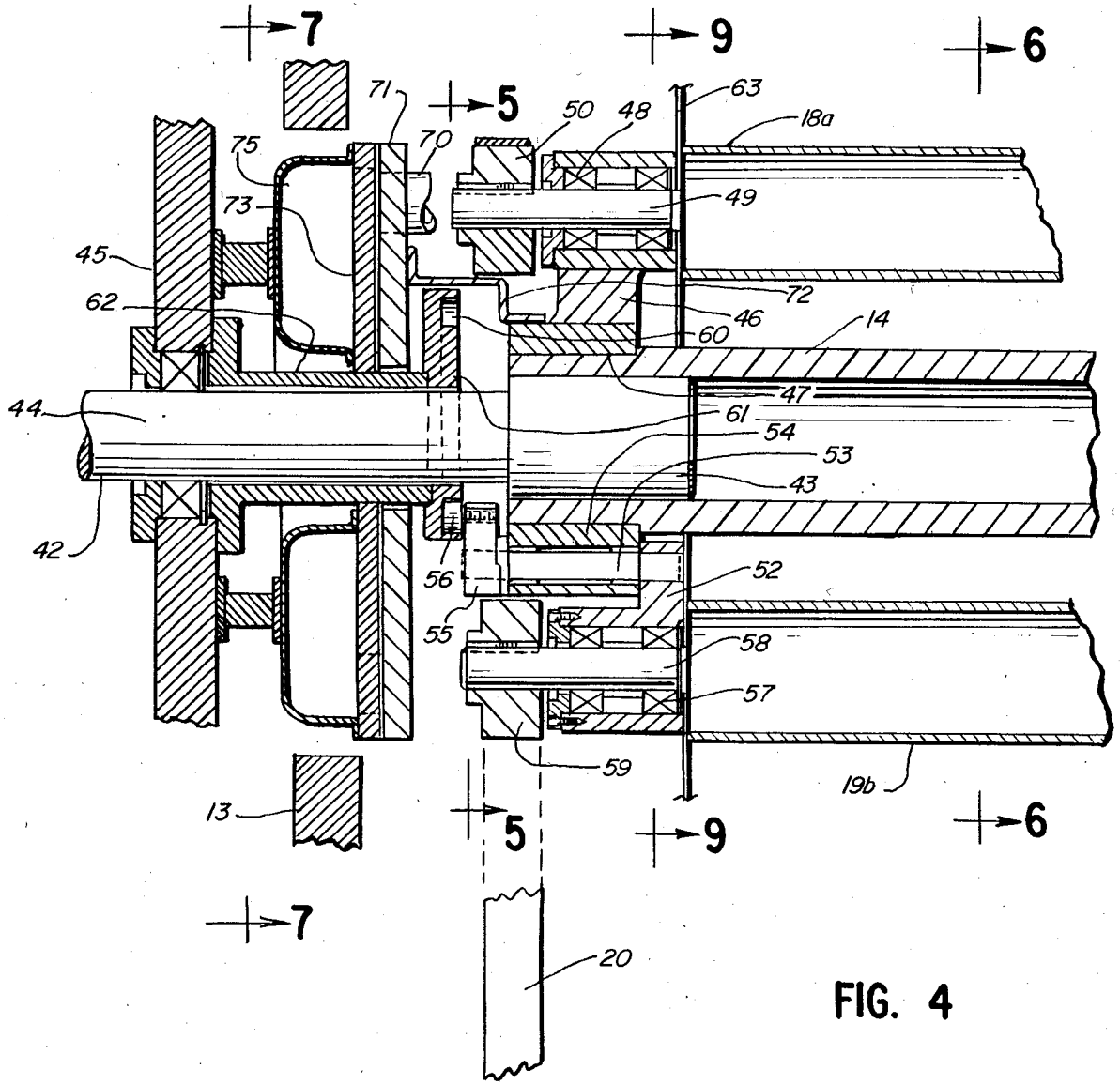
FIG. 4 is a fragmentary cross sectional view taken along the line 4—4 of FIG. 3.

Referring now to FIG. 4, the turret tube 14 is supported for rotation by a pair of shafts 42 which are inserted into the ends of the tube. Each shaft 42 has a radially enlarged inner end portion 43 which is secured to the turret tube and a journal portion 44 which is rotatably mounted in wall 45 of the rewinder frame.

The cradle roller 18*a* is mounted on the turret tube 14 in a fixed position by a mounting bracket 46 on each end of the roller. The mounting bracket is bolted to a flat 47 which is machined on the surface of the turret tube. The bracket 46 supports a bearing 48 which rotatably supports a shaft 49 extending from the cradle roller. A pulley 50 is mounted on the end of the shaft 49 and is driven by the belt 20.

The cradle roller 19*b* in FIG. 4 is pivotally mounted on the turret tube by a bearing bracket 52 which is attached to a pivot shaft 53. The pivot shaft is rotatably supported by a journal block 54 which is attached to a flat on the turret tube. The left end of the pivot shaft is connected to a lever arm 55 which supports a cam follower 56. The bearing bracket 52 supports a bearing 57 which rotatably supports a shaft 58 on the cradle roller 19*b*. A pulley 59 on the shaft is driven by the belt 20.

Figure 5:
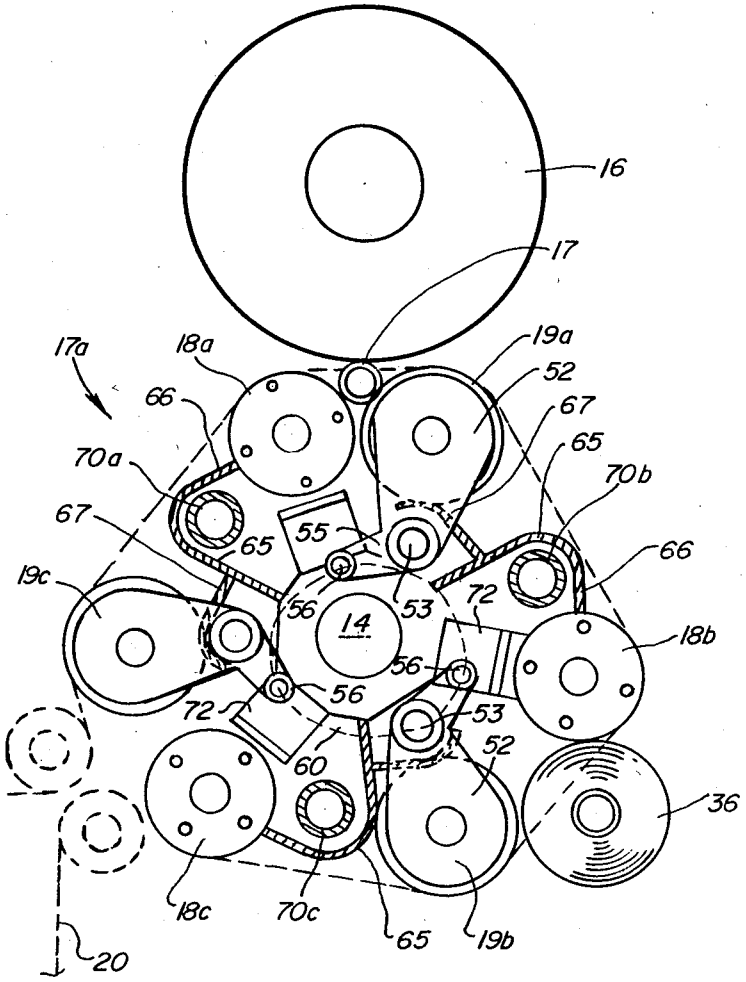
FIG. 5 is a sectional view similar to FIG. 3 taken along the line 5—5 of FIG. 4.

Referring to FIG. 5, cradle rollers 18*b* and 18*c* are fixed to the turret tube in the same way as the cradle roller 18*a*, and the cradle rollers 19*a* and 19*c* are pivotally mounted on the turret tube in the same way as the cradle roller 19*b*.

The cam follower 56 rides in a groove or track 60 formed in a stationary cam plate 61 (see FIG. 4). The cam plate encircles the turret shaft 44 and is supported by a sleeve 62 which is attached to the frame wall 45. As the cam follower is moved radially inwardly or outwardly by the cam track 60, the lever arm rotates the pivot shaft 53, the bracket 52, and the cradle roller 19*b*.

The contour of the cam track 60 is illustrated in dotted outline in FIG. 5. The cam track causes the pivoting cradle rollers of each pair of rollers to move away from its associated fixed roller as the pair of rollers orbit from the web-attaching station at 12 o'clock in FIG. 2 to the core discharge station at 4 o'clock. The increasing space between the rollers accommodates the increasing diameter of the wound core and increases the area of the wound core against which the vacuum acts, thereby increasing the vacuum holding force as the core and attached web wind into a finished log. As the cradle rollers continue to orbit past the discharge station, the cam moves the pivoting roller back toward the fixed roller to receive a new core at the core-feeding station 17*a*.

Figure 9:
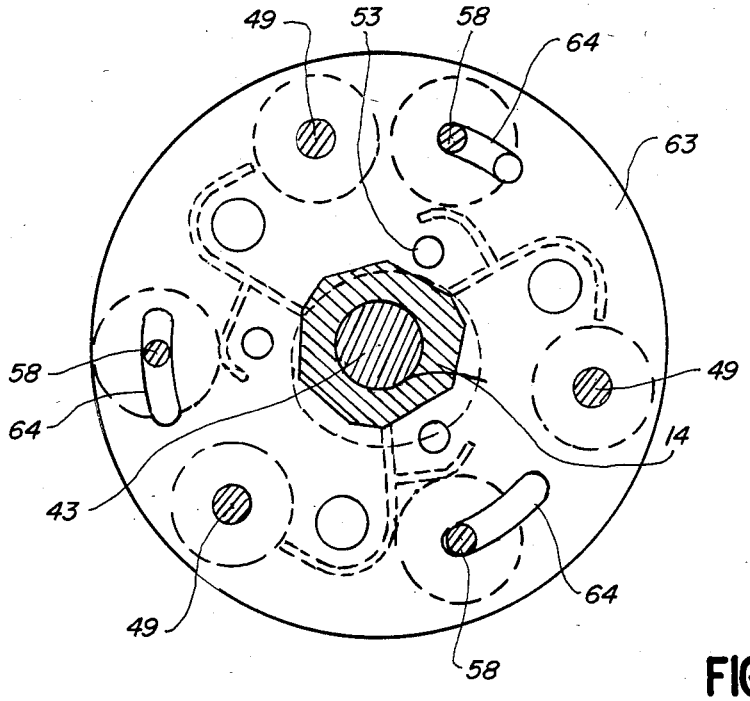
FIG. 9 is a fragmentary sectional view taken along the line 9—9 of FIG. 4.

A pair of end plates 63 (FIG. 4) are supported by the turret tube and extend radially outwardly beyond the shafts 49 and 58 of the three pairs of cradle rollers. Referring to FIG. 9, each end plate is provided with three circular openings for the three shafts 49 and three arcuate slots 64 for the pivotable shafts 58.

Figure 6:
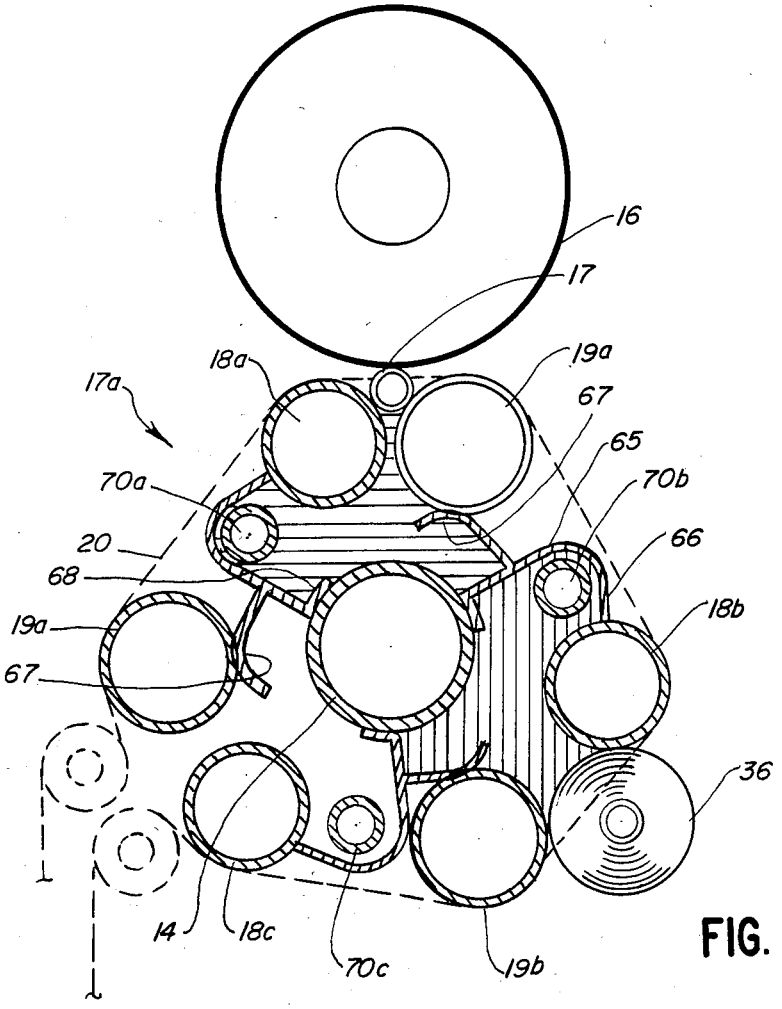
FIG. 6 is a sectional view taken along the line 6—6 of FIG. 4.

Referring now to FIG. 6, three vacuum chamber walls 65 are supported by the turret tube 14 between adjacent pairs of cradle rollers. The vacuum chamber walls extend for the entire length of the cradle rollers between the two end plates 63, and each vacuum chamber wall includes an outer end portion 66 which curves in a clockwise direction and an intermediate portion 67 which curves in a counterclockwise direction. Each outer end portion 66 terminates adjacent a fixed cradle roll 18. Each intermediate portion 67 curves below a pivoting cradle roller 19, and the curvature of the intermediate portion 67 is such that the intermediate portion 67 remains closely adjacent the cradle roller 19 as it pivots on shaft 53. The bottom of each wall 65 terminates in a flange 68 (FIG. 6) which is bolted to the turret tube 14.

A vacuum chamber or plenum is formed for each pair of cradle rollers by the space bounded by the turret tube 14, two end plates 63, two vacuum chamber walls 65, and the two cradle rollers. A partial vacuum can be drawn in each vacuum chamber through vacuum tubes 70*a*, 70*b*, and 70*c* which extend through the two end plates 63 and which communicate with vacuum in shroud 75 (FIGS. 4 and 8) through a coacting opening 70 to plate 71 and slot 74 in plate 73. Each tube 70 advantageously extends into the vacuum chamber for about half the length of the cradle rollers so that the vacuum is drawn in the middle of the chamber rather than at the ends.

Figure 7:
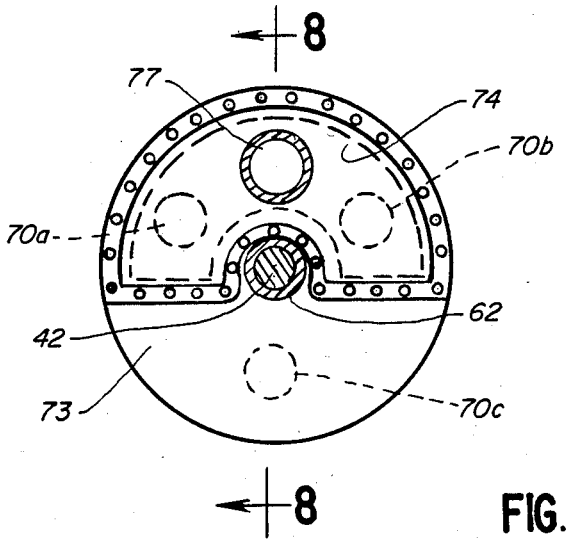
FIG. 7 is an end view of vacuum valve assembly taken along the line 7—7 of FIG. 4.
Figure 8:
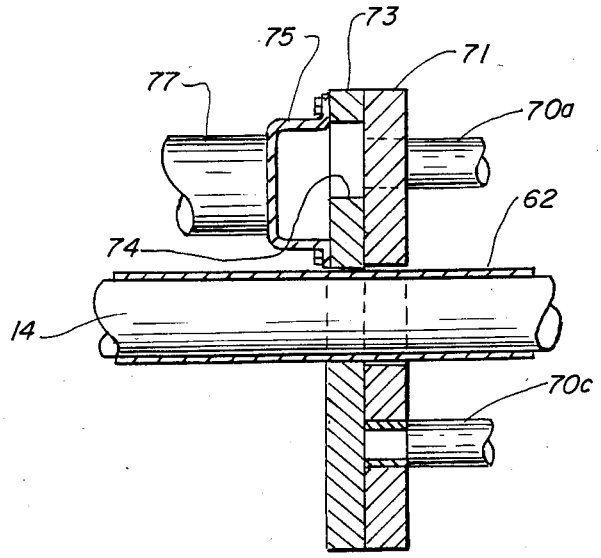
FIG. 8 is a sectional view of the vacuum valve assembly taken along the line 8—8 of FIG. 7.

Referring to FIGS. 4, 7, and 8, each vacuum tube 70*a*–70*c* is connected to an opening in a plate 71 which rotates with the turret. The rotating plate 71 is connected to the mounting bracket 46 for the fixed cradle rollers 18 by brackets 72 (FIG. 4). The rotating plate rotates against a stationary plate 73 which is mounted on the sleeve 62, and a U-shaped slot 74 is provided in the stationary plate and extends through an arc of about 180°. A U-shaped shroud 75 is mounted on the outside of the stationary plate 73 and covers the slot 74. The shroud is connected to a conventional vacuum pump 76 (FIG. 1) by a tube 77.

The plates 71 and 73 and the shroud 75 act as a valve for the vacuum. As each of the vacuum tubes 70*a*–70*c* rotates into communication with the slot 74 in the stationary plate 73, that vacuum tube and its associated vacuum chamber is connected to the vacuum pump, and a vacuum is drawn in the vacuum chamber. When the vacuum tube rotates past the slot 74, the vacuum is shut off from the associated chamber, and the chamber returns to atmospheric pressure. Each chamber will therefore be under vacuum for about 180° of each revolution of the turret.

The orientation of the U-shaped slot 74 and the length of the arc thereof is such that the vacuum chamber for a particular pair of cradle rollers is connected to the vacuum pump when the cradle rollers orbit past the core-feeding station 17*a* in FIG. 2. The air pressure within the vacuum chamber is reduced below atmospheric pressure by the vacuum pump, and the pressure differential on opposite sides of the rollers causes air to be sucked through the space between the rollers. As the core is delivered to the rollers, the air pressure or suction in the space between the rollers will draw the core against the rollers and will cause the core to rotate with the rollers.

The vacuum is maintained on the core as the core and the rollers orbit past the web-attaching station which is occupied by the rollers 18*a* and 19*a* at the 12 o'clock position in FIG. 2. The web is wound on the rotating core as the core and the rollers continue to orbit to the discharge station which is occupied by the rollers 18*b* and 19*b* at the 4 o'clock position. As the rollers 18*b* and 19*b* reach the discharge station, the vacuum tube 70*b* passes over the end of the U-shaped slot 74, and the vacuum pump is shut off from the rollers. The wound log 36 then falls by gravity away from the rollers into the discharge trough 26 (FIG. 1).

FIG. 6 illustrates the turret just before the log 36 reaches the discharge position. The vacuum chamber for the rollers 18*a* and 19*a* is connected to the vacuum pump as indicated by the horizontal crosshatching, and the vacuum chamber for the rollers 18*b* and 19*b* is connected to the vacuum pump as indicated by the vertical crosshatching. The vacuum chamber for the rollers 18*c* and 19*c* is at atmospheric pressure.

The cradle rollers continuously rotate, and the vacuum chamber walls 65 are in close proximity to and/or have sealing contact with the rollers. If desired, seal means such as felt strips or the like can be attached to the vacuum chamber walls for reducing air leakage between the walls and the rollers. However, I have found that the flow of air which is pulled by a conventional turbine type vacuum producer is sufficient to hold the core and the wound log on the rollers despite leakage of air between the rollers and the vacuum chamber walls. There is also some leakage of air between the ends of the core and the end plates 63 at the ends of the cradle rollers. Again, this leakage is not sufficient to prevent the core from being held against the rollers.

In a rewinder for toilet paper, a partial vacuum of only about 2 to 3 inches of mercury in the vacuum chamber is sufficient to hold the core and the wound log against the rotating cradle rollers. This is measured on a scale of zero inches for no vacuum or atmospheric pressure and about 30 inches for a perfect vacuum.

Figure 10:
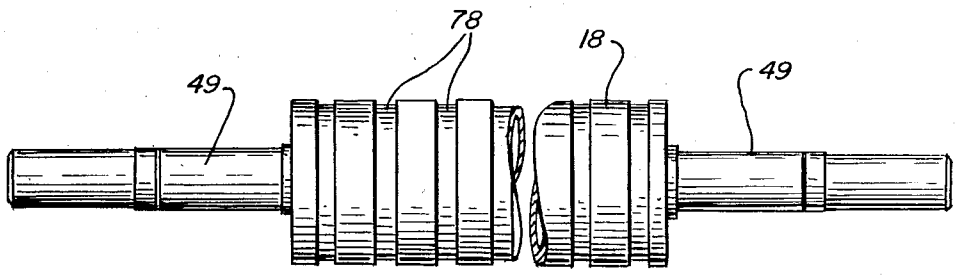
FIG. 10 is a front view of a typical roller used in pairs to support the core and winding log.

In one specific embodiment of a rewinder for toilet paper, the diameter of the cradle rollers was 4.5 inches and the length of the cradle rollers was 102 inches. Each cradle roller was provided with a plurality of axially spaced circumferentially extending grooves 78 (FIG. 10) having a depth of 1/64 inch and an axial width of ¾ inch. The grooves were designed to accommodate the bands of glue on the core so that the glue is not smeared over the surface of the cradle rollers. The diameter of the core was 1.5 inches, and the length of the core was 101 inches. The initial space between the rollers when the core was delivered at the core-feeding station was ¼ inch, and this space was increased to 1¼ inch as the core was wound. The weight of the core was ½ pounds, and a force of about 10 pounds concentrated at the center was required to pull the unwound core away from the rollers when a vacuum of about 2 to 3 inches was drawn in the vacuum chamber. The weight of the wound log was about 7 pounds, and a force of about 12 pounds concentrated at the center was required to pull the wound log from the rollers when the rollers were positioned so that the amount of force required to remove the wound log was not affected by gravity.

It is within the scope of the invention to drive the cradle rollers 18 and 19 at speeds equal to the surface speed of the bedroll 16, at an equal speed which is different from the speed of the bedroll, or at speeds which are different from each other. In the embodiment illustrated in the drawing, the pulleys 50 and 59 which are driven by the belt 20 are mounted on the same side of the rollers. If desired, however, pulleys could be mounted only on the fixed rollers 18*a*, 18*b*, and 18*c*, and the rollers 19*a*–19*c* can idle. Alternatively, drive pulleys for the rollers 19*a*–19*c* can be mounted on the other ends of the rollers and driven by a separate drive belt at a different speed than the speed of rollers 18*a*–18*c*. Further, the drive for the belt 20 can be a variable speed drive so that the surface speed of the cradle rollers can match the speed of the bedroll during a given portion of the winding cycle.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. An apparatus for winding a web of sheet material into a roll on a core comprising:

(a) a frame, (b) a pair of rollers for supporting the core rotatably mounted on the frame and having a space therebetween, (c) a vacuum chamber outside said rollers within the frame communicating with the space between the rollers, the space between the rollers being sized to support a core and thereby close said chamber, and (d) means for reducing the air pressure in the vacuum chamber and for holdin a core for a roll in the sapce between the rollers by air pressure and the web can be wound on the core by rotating the core with the rollers.

2. The apparatus of claim 1 including a turret rotatably mounted on the frame, said pair of rollers being rotatably mounted on the turret, the turret being rotatable to move the pair of rollers from a core-feeding station to a discharge station.

3. The apparatus of claim 2 in which one of the rollers is mounted on the turret for movement toward and away from the other roller whereby the space between the rollers can be increased as the web is wound on the core.

4. The apparatus of claim 2 including means for pivotally mounting one of the rollers on the turret so that said one roller can pivot toward and away from the other roller, a cam on the frame, and a cam follower on the pivotable mounting means for said one roller and engaging the cam, the contour of the cam causing said one roller to pivot away from the other roller as the rollers move between the core-feeding station and the discharge station.

5. An apparatus for winding a web of sheet material into a roll on a core comprising: a frame, a pair of rollers rotatably mounted on the frame and having a space therebetween, a vacuum chamber within the frame communicating with the space between the rollers, means for reducing the air pressure in the vacuum chamber whereby a core for a roll can be held in the space between the rollers by air pressure and the web can be wound on the core by rotating the core with the rollers, and a turret rotatably mounted on the frame, said pair of rollers being rotatably mounted on the turret, the turret being rotatable to move the pair of rollers from a core feeding station to a discharge station, said turret including a shaft rotatably mounted on the frame, the vacuum chamber including a pair of chamber walls which are supported from the turret shaft and extend upwardly to adjacent the surfaces of the rollers.

6. An apparatus for winding a web of sheet material into a roll on a core comprising: a frame, a pair of rollers rotatably mounted on the frame and having a space therebetween, a vacuum chamber within the frame communicating with the space between the rollers, means for reducing the air pressure in the vacuum chamber whereby a core for a roll can be held in the space between the rollers by air pressure and the web can be wound on the core by rotating the core with the rollers, and a turret rotatably mounted on the frame, said pair of rollers being rotatably mounted on the turret, the turret being rotatable to move the pair of rollers from a core feeding station to a discharge station, said turret including a shaft rotatably mounted on the frame and a pair of end plates which extend from the turret shaft to the rollers, at least one of the end plates being provided with an opening which communicates with the vacuum chamber for drawing a vacuum in the vacuum chamber, a stationary plate mounted on the frame adjacent said one end plate, said stationary plate being provided with an opening which communicates with the pressure reducing means and which communicates with the opening in said one end plate for at least a portion of each revolution of the turret whereby the air pressure is reduced in the vacuum chamber when the opening in said one end plate communicates with the opening in said stationary plate.

7. The apparatus of claim 6 in which the opening in said stationary plate is an arcuate slot which extends over an arc of less than 360°.

8. The apparatus of claim 6 including a rotating plate which is mounted on the turret for rotation therewith adjacent the stationary plate, the rotating plate having an opening therein and means connecting the opening in the rotating plate with the opening in said one end plate whereby the opening in said stationary plate communicates with the opening in said one end plate when the opening in the rotating plate is aligned with the opening in the stationary plate.

9. The apparatus of claim 8 in which the opening in said stationary plate is an arcuate slot which extends over an arc of less than 360°.

10. An apparatus for winding a web of sheet material into a roll on a core comprising: a frame, a pair of rollers rotatably mounted on the frame and having a space therebetween, a vacuum chamber within the frame communicating with the space between the rollers, means for reducing the air pressure in the vacuum chamber whereby a core for a roll can be held in the space between the rollers by air pressure and the web can be wound on the core by rotating the core with the rollers, and a turret shaft rotatably mounted on the frame, said pair of rollers being mounted on the turret shaft for rotation about axes which extend parallel to the turret shaft, one of the rollers being mounted on the turret shaft for pivotal movement toward and away from the other roller whereby the space between the rollers can be increased as the web is wound on the core, the turret shaft being rotatable to move the pair of rollers from a core-feeding station to a discharge station, the vacuum chamber being provided by a first chamber wall which is supported from the turret shaft and which terminates in an arcuate end portion which is adjacent said one roller as said one roller pivots toward and away from the other roller and a second chamber wall which is supported from the turret shaft and which extends to adjacent the other roller.

11. The apparatus of claim 10 including a pair of end plates which extend upwardly from the turret shaft to the rollers, at least one of the end plates being provided with an opening which communicates with the vacuum chamber for reducing the air pressure in the vacuum chamber, a stationary plate mounted on the frame adjacent said one end plate, said stationary plate being provided with an opening which communicates with the pressure reducing means and which communicates with the opening in said one end plate for at least a portion of each revolution of the turret whereby the air pressure is reduced in the vacuum chamber when the opening in said one end plate communicates with the opening in said stationary plate.

12. The apparatus of claim 10 including a cam on the frame and a cam follower connected to said one roller and engaging the cam, the contour of the cam causing said one roller to pivot away from the other roller as the rollers move between the core-feeding station and the discharge station.

13. An apparatus for winding a web of sheet material into a roll on a core comprising: a frame, a turret rotatably mounted on the frame, a plurality of pairs of rollers mounted on the turret for rotation about axes which extend parallel to the axis of rotation of the turret, each pair of rollers having a space between the rollers, a vacuum chamber in the turret for each pair of rollers, each vacuum chamber communicating with the space between a pair of rollers, and means for reducing the air pressure in the vacuum chambers whereby a core for a roll can be held in the space between a pair of rollers by air pressure and the web can be wound on the core by rotating the core with the rollers, said turret including: a shaft rotatably mounted on the frame, each vacuum chamber being provided by a first chamber wall which is supported from the turret shaft and which extends to adjacent the surface of one of the rollers of a pair and a second chamber wall which is supported from the turret shaft and which extends to adjacent the other roller of the pair.

14. The apparatus of claim 13 in which the turret includes a pair of end plates which extend from the turret shaft on opposite ends of the rollers, at least one of the end plates being provided with an opening for each of the vacuum chambers for reducing the air pressure in the vaccum chamber, and valve means for communicating the pressure reducing means with each of the vaccum chambers for at least a portion of each revolution of the turret.

15. The apparatus of claim 14 in which the valve means includes a stationary plate mounted on the frame and a rotating plate mounted on the turret for rotation adjacent the stationary plate, the stationary plate being provided with an opening which communicates with the pressure reducing means, the rotating plate being provided with an opening for each of the vacuum chambers, and means for connecting each of the openings in the rotating plate with one of the openings in said one end plate whereby a vacuum is pulled in a vacuum chamber when the opening in the rotating plate for that chamber communicates with the opening in the stationary plate.

16. The apparatus of claim 15 in which the opening in the stationary plate is an arcuate slot which extends over an arc of less, than 360°.

17. The apparatus of claim 16 including a bedroll rotatably mounted on the frame for advancing the web toward the rollers and means for rotating the rollers.

18. An apparatus for winding a web of sheed material into a roll on a core comprising: a frame, a turret rotatably mounted on the frame, a plurality of pairs of rollers mounted on the turret for rotation about axes which extend parallel to the axis of rotation of the turret, each pair of rollers having a space between the rollers, a vacuum chamber in the turret for each pair of rollers, each vacuum chamber communicating with the space between a pair of rollers, means for reducing the air pressure in the vacuum chambers whereby a core for a roll can be held in the space between a pair of rollers by air pressure and the web can be wound on the core by rotating the core with the rollers and a bedroll rotatably mounted on the frame for advancing the web toward the rollers, said bedroll having web cutoff means operably associated therewith whereby leading edge of a severed web is provided on said bedroll for transfer to said core.

19. A method of winding a core with a web of sheet material comprising the steps of:

(a) reducing the air pressure in a space between a pair of rollers, (b) inserting a core in said space and holding the core against the rollers by air pressure, (c) rotating the rollers to rotate the core, and (d) attaching the web to the core and winding the web on the rotating core.

20. The method of claim 19 including the step of removing the vaccum from said space after the web is wound on the core so that the wound core can be removed from the space.

21. The method of claim 20 including the step of moving the rollers and the core between a core-feeding station and a discharge station, the web being attached to the core between the core-feeding station and the discharge station, and the vacuum being removed when the rollers are at the discharge station.

22. The method of claim 21 in which the core falls by gravity from the rollers at the discharge station.

23. The method of claim 19 in which the web is advanced toward the rollers by a rotating bedroll and the rollers are rotated at the same speed as the bedroll.

24. The method of claim 19 in which the web is advanced toward the rollers by a rotating bedroll and the rollers are rotated at the same speed which is different than the speed of the bedroll.

25. The method of claim 19 in which the web is advanced toward the rollers by a rotating bedroll and the rollers are rotated at different speeds, one of the rollers being rotated at the same speed as the bedroll.

26. The method of claim 19 in which the web is advanced toward the rollers by a rotating bedroll, and the rollers are rotated at different speeds, both of the rollers being rotated at a different speed than the bedroll.

27. A method of winding a core with a web of sheet material comprising the steps of providing a free edge of a web on a bedroll, advancing said free edge on said bedroll toward a turret equipped with a pair of spaced rollers, reducing the air pressure in said space between said pair of rollers, inserting a core in said space and holding the core against the rollers by air pressure, rotating the rollers to rotate the core, and attaching said free edge to the core and winding the web on the rotating core.

* * * * *